US005338387A

United States Patent [19]

Noll

[11] Patent Number: 5,338,387

[45] Date of Patent: * Aug. 16, 1994

[54] MODULAR APPARATUS FOR PREPARING ARTICLES TO BE MAILED

[76] Inventor: Marvin H. Noll, 634 Lake Shore Dr., Parsippany, N.J. 07054

[ * ] Notice: The portion of the term of this patent subsequent to May 24, 2011 has been disclaimed.

[21] Appl. No.: 165,016

[22] Filed: Dec. 9, 1993

Related U.S. Application Data

[63] Continuation-in-part of Ser. No. 60,741, May 12, 1993.

[51] Int. Cl.[5] ..... B43M 3/00

[52] U.S. Cl. ..... 156/441.5; 156/353; 156/361; 156/363; 156/442; 271/2

[58] Field of Search ..... 156/441.5, 442, 442.1, 156/442.2, 442.3, 64, 353, 355, 361, 362, 363; 271/2

[56] References Cited

U.S. PATENT DOCUMENTS

| | | | |
|---|---|---|---|
| 2,346,142 | 4/1944 | Anderson | 156/483 |
| 3,245,859 | 4/1966 | Busk | 156/484 |
| 3,446,690 | 5/1969 | Charles | 156/446 |
| 3,721,601 | 3/1973 | Pituch et al. | 156/442 |
| 4,473,429 | 9/1984 | Crankshaw | 156/483 |
| 4,601,771 | 7/1986 | Wesley | 156/447 |
| 4,850,580 | 7/1989 | Denzin et al. | 271/2 |
| 4,926,787 | 5/1990 | Fassman et al. | 156/441.5 |

*Primary Examiner*—David A. Simmons
*Assistant Examiner*—William J. Matney, Jr.
*Attorney, Agent, or Firm*—Anthony J. Casella; Gerald E. Hespos

[57] ABSTRACT

A modular assembly of components is provided for various aspects of high volume mailing. The modular system of components includes a postage meter, having a base with a driving motor and a head driven by the driving motor and operative to apply selected postage to a piece of mail. The postage meter head can be selectively removed from the postage meter base. The modular systems of components further includes at least one accessory selectively mountable to the postage meter base and capable of being driven thereby. The accessory may include an applicator for applying a closure tab, a label or a stamp to an envelope or sheet of material being driven by the postage meter base.

16 Claims, 4 Drawing Sheets

MODULAR APPARATUS FOR PREPARING ARTICLES TO BE MAILED

This application is a continuation-in-part of application Ser. No. 08/060,741 which was filed on May 12, 1993.

BACKGROUND OF THE INVENTION

1. Field of the Invention

The subject invention relates to apparatus employing a postage meter base to drive one or more modular components for applying closure tabs or labels to articles to be mailed.

2. Description of the Prior Art

Special purpose machines are available for virtually all tasks associated with mailing. For example, copy machines are available to photostatically copy material to be mailed and to collate the copies. Other special purpose machines are available to fold sheets of paper, while still other special purpose machines are available to insert sheets into envelopes. Special purpose machines are available to apply labels to envelopes or to sheets of paper, while still other special purpose machines are available to apply closure tabs across adjacent edges of a sheet to hold a folded sheet closed for mailing without an envelope.

Special purpose machines for many aspects of mass mailing typically are very expensive. Thus, only large volume mailers, such as banks, insurance companies, stock brokers and the like will own the dedicated machines to facilitate all phases of their mass mailing operations. Smaller businesses that do lower volumes of mailing often retain the services of mailing companies to assist in reproduction, folding, inserting, labeling, applying postage and/or actual mailing. However, mailing companies charge for their services, and thus the use of a mailing company generally imposes a cost penalty on the low to medium volume mailers.

Virtually all businesses own a photostatic copy machine and a postage machine. These universally available pieces of equipment may be suitable for certain parts of a business mailing, and the small business could utilize its own equipment to reproduce material to be mailed and to apply postage. However, other mailing tasks, such as applying labels or closure tabs might require a slow and inefficient manual process that diverts personnel for more productive activities.

Postage meters found in virtually all small businesses include a base and a head. The base includes an electric motor which operates mechanical components in both the base and the head. The mechanical components in the base drive material to be posted through the postage meter. The head typically is entirely mechanical and merely applies postage to the sheet material driven by the base. The head is removable from the base for periodic inspection and maintenance, and for application of postage.

A significant unmet need exists for office equipment that enables a small business to use automated equipment more efficiently for mailing or otherwise distributing material. For example, inexpensive equipment to apply closure tabs and/or labels could enable small businesses to perform significant mailings in-house, without the cost and inconvenience of diverting office personnel from more productive endeavors and without hiring outside mailing services.

In view of the above, it is an object of the subject invention to provide efficient apparatus for applying closure tabs and/or labels to material being mailed.

It is another object of the subject invention to provide apparatus which can be driven by available equipment in most offices for applying closure tabs and/or labels.

It is a further object of the subject invention to provide a modular assembly of office machines using a common drive mechanism with interchangeable heads for performing each of several optional office functions.

SUMMARY OF THE INVENTION

The subject invention is directed to modular apparatus for preparing material to be mailed. The modular apparatus includes a postage meter having a base and a head removably mounted to the base. The base includes a motor for driving components in both the base and the head. The apparatus further includes at least one alternate head removably mountable to the base and drivable by the motor of the base. For example, the alternate head may include means for applying closure tabs, labels and/or stamps to articles to be mailed. The tab, label and/or stamp applicator includes a supply of closure tabs and/or labels which may be mounted, for example, on carrier strips. The carrier strips may be transported from a supply reel to a take-up reel both of which may be removably mounted in the alternate head. In other embodiments, however, tabs, labels or stamps may be wound onto a supply reel without a carrier strip and without a take-up reel. Individual tabs, labels or stamps on the reel may be unitarily connected to one another along a frangible line, such as a perforation line, that may be severed by bursting means to enable individual tabs, labels or stamps to be applied to an envelope, card or other sheet material passing through the apparatus. Closure tabs, labels and/or stamps are sequentially driven into an appropriate location for application to sheet material being processed by the modular assembly comprising the postage meter base and the alternate head.

The modular apparatus of the subject invention may be used by removing the head of a postage meter from the base. The closure tab applicator, stamp applicator or label applicator then may be securely mounted to the base for cooperation with the driving mechanism of the base. Thus, the base of the available postage meter is used to selectively apply closure tabs, stamps or labels to sheets of material or to apply labels to sheets of material. After completing the application of closure tabs, stamps and/or labels to sheets of material, the closure tab applicator, the stamp applicator or the label applicator may be removed from the postage meter base, and the postage meter head may be remounted to the postage meter base for continued normal usage.

The closure tab applicator, stamp applicator or label applicator may be sold separately for use with a postage meter owned or leased by a consumer. On the other hand, consumers may purchase or lease a modular assembly of components, including a postage meter base, a postage meter head, and one or more modular accessories, such as a closure tab applicator, stamp applicator or a label applicator. The modular assembly may be reconfigured in accordance with a day-to-day mailing needs of the consumer.

DETAILED DESCRIPTION OF THE PREFERRED EMBODIMENT

Figure 1:
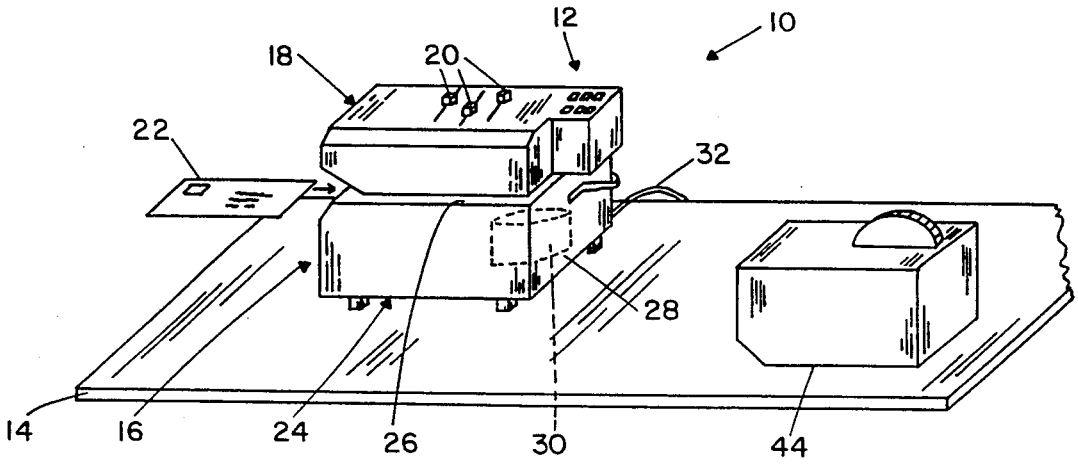
FIG. 1 is a perspective view of an assembly of modular components of the subject invention in a first optional configuration.
Figure 2:
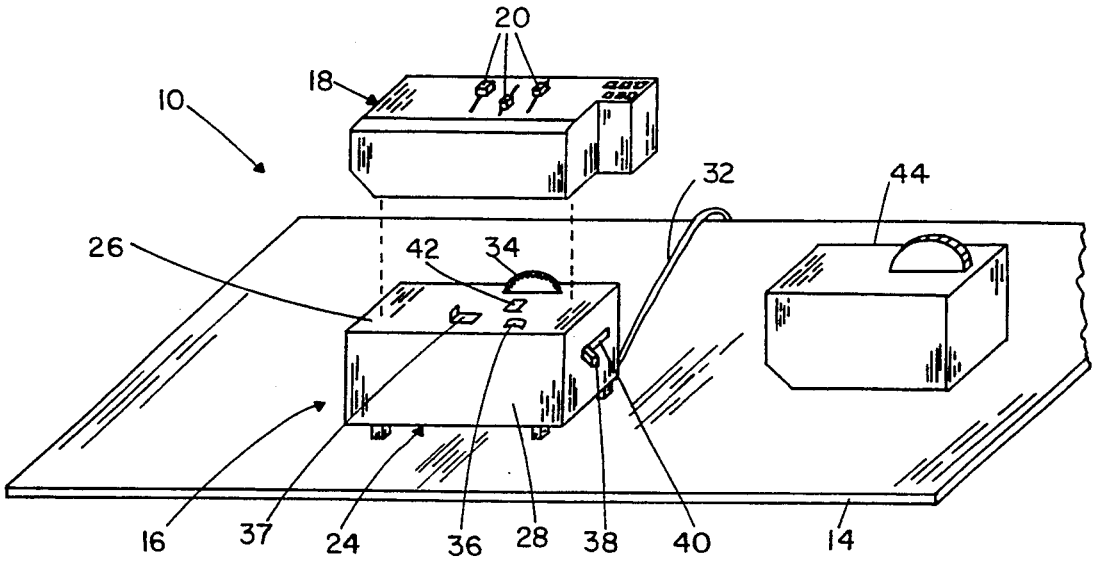
FIG. 2 is a perspective view of the components in FIG. 1 in their fully disassembled condition.
Figure 3:
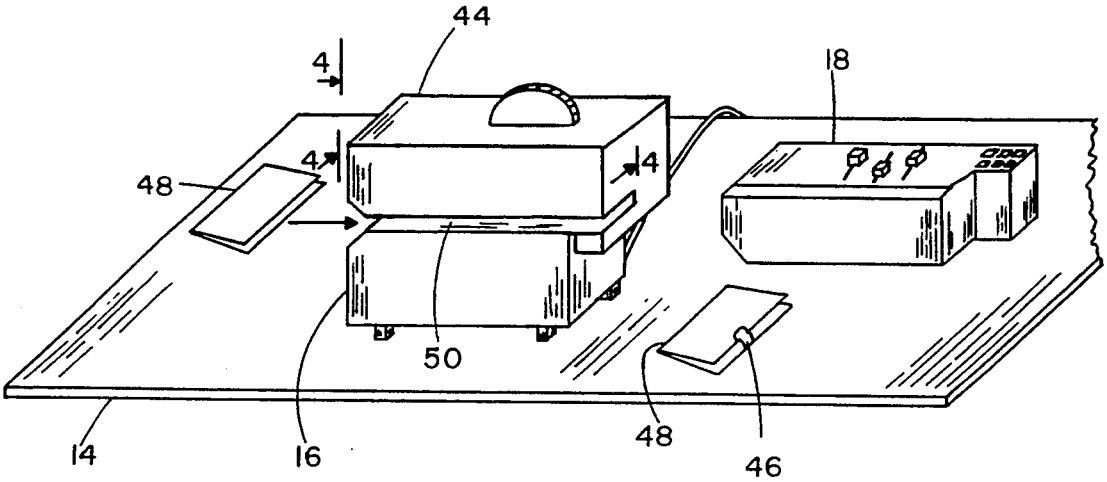
FIG. 3 is a perspective view showing the modular components in a second operational configuration.

An assembly of modular components in accordance with the subject invention is identified generally by the numeral 10 in FIGS. 1-3. The assembly of modular components 10 includes a postage meter 12 suitably dimensioned for mounting on a desk or table 14. The postage meter 12 of the modular assembly 10 may be similar or identical to meters manufactured by Pitney-Bowes, Freiden/Singer, Postalia or Hassler. The postage meter 12 includes a base 16 and a head 18. The postage meter head 18 includes levers 20 for selecting a desired amount of postage to be applied to an envelope 22. The postage meter head 18 is operative to print indicia on the envelope 22 corresponding to the postage selected with the levers 20. The printing is carried out by an adjustable printing head which is driven into contact with the envelope 22.

The postage meter head 18 is effectively a slave component driven by the postage meter base 16. More particularly, the postage meter base 16 includes a housing 24 having a top wall 26 and a plurality of side walls 28. An electric motor 30 is disposed in the housing 24 and is powered by electric current delivered through a conventional power cord 32. The motor 30 drives a gear wheel 34 which projects above the top wall 26 of the housing 24 of the postage meter base 16. The gear 34 is dimensioned and disposed to extend into the postage meter head 18 for driving the printing head to print indicia on the envelope 22. The motor 30 also operates a drive roller 36 for driving the envelope 22 through the postage meter 12. The motor 30 is actuated to drive the gear 34 and the roller 36 by a switch 37 which is triggered by insertion of the envelope 22 between the base 16 and head 18.

The postage meter base 16 includes a locking handle 38 projecting through a slot 40 in the side wall 28 of the housing 24. The handle is operative to rotate a lock 42 which projects above the top wall 26 of the housing 24 and which is engageable in a corresponding aperture of the postage meter head 18. In a rearward orientation of the handle 38, as shown in FIG. 1, the postage meter head 18 is lockingly engaged to the postage meter base 16. In a forward position of the handle 38, as shown in FIG. 2, the postage meter head 18 is selectively removable from the postage meter base 16. As explained above, removal of the postage meter head 18 from the postage meter base 16 may be required periodically for maintenance, for certification by postal authorities or for application of additional postage thereto.

The modular system 10 shown in FIGS. 1-3 further includes an applicator head 44 which can be selectively mounted to the postage meter base 16 after the postage meter head 18 has been removed therefrom. The applicator head 44 cooperates with the postage meter base 16 to apply a closure tab 46 to a folded sheet of material 48 as the folded sheet 48 is passed through the slot 50 between the postage meter base 16 and the applicator head 44. As explained further herein, the sheet 48 is initially placed into slot 50 in substantially the same manner as an envelope to which postage is being applied. The folded sheet 48 triggers the switch 37 to actuate the drive roller 36 and to rotate the gear 34 of the postage meter base 16 for operating the applicator head 44 as explained herein.

Figure 4:
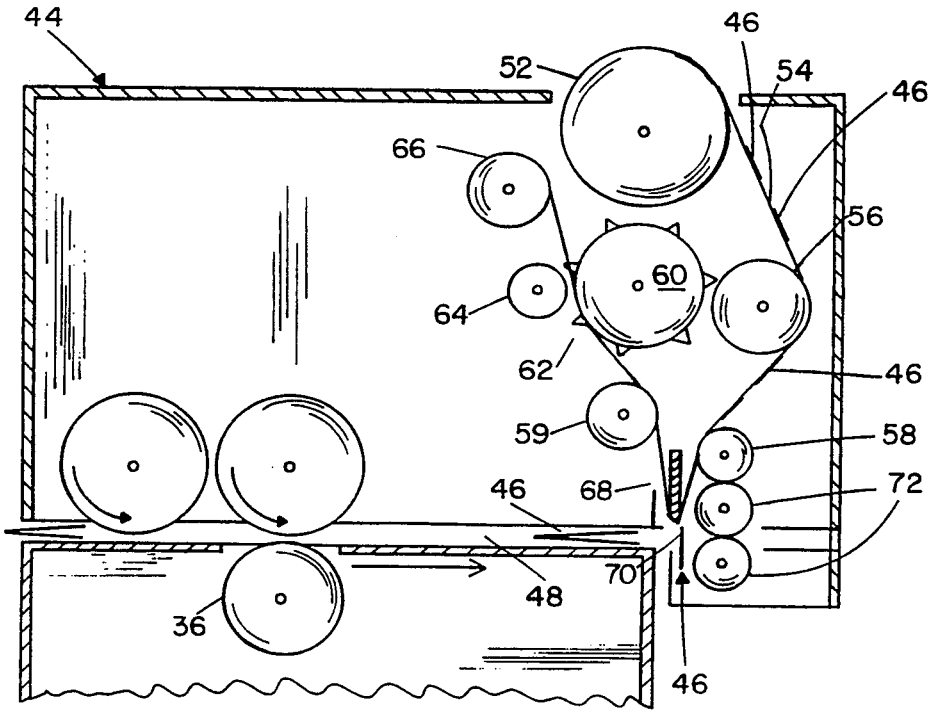
FIG. 4 is a cross-sectional view taken along line 4—4 in FIG. 3.

With reference to FIG. 4, the closure tab applicator head 44 includes a tab feed reel 52 on which a carrier strip 54 is stored. The carrier strip 54 transports a plurality of the closure tabs 46. The carrier strip 54 is transported around a take-up reel 56 and a guide wheels 58, 59 which are disposed in proximity to the slot 48. A pinwheel 60 has a plurality of circumferentially spaced pins 62 projecting therefrom. The pins 62 are dimensioned and spaced to engage corresponding apertures in the carrier strip 54 to enable precise incremental advancement of the carrier strip 54 as explained herein. The pinwheel 60 is rotatably driven by the motor 30 of the postage meter base 16. A guide wheel 64 guides the carrier strip 54 to a rewind reel 66.

A peel bar 68 is disposed intermediate the guide wheels 58 and 59 and defines an abrupt edge about which the carrier strip 54 must pass. In this regard, the carrier strip 54 undergoes close to a 180° change in direction in traversing the peel bar 68. As a result of this change of direction, each closure tab 46 traversing the peel bar 68 will continue substantially in a straight line defining a tangent extending from the guide wheel 58 to the peel bar 68. Hence, closure tabs 46 will separate from carrier strip 54 as the carrier strip 54 undergoes the substantially 180° in direction around the peel bar 68. The folded sheet 48 passing into the slot 50 will trigger the switch 37 and actuate the motor 30 of postage meter base 16 substantially in the manner as the envelope 22 having postage applied by the postage meter 12. The motor 30 will rotate drive wheel 36 and urge the sheet 48 through the slot 50. Simultaneously, the pinwheel 60 will be driven by the motor 30 to advance the carrier strip 54 incrementally and to urge one of the closure tabs 46 into the position shown in FIG. 4. More particularly, the closure tab 46 will be disposed in the slot 50 with its adhesive side 70 facing in a position to be engaged by the advancing folded sheet 48. The folded sheet 48 then will advance into the adhesive side 70 of the waiting closure tab 50. Momentum of the moving sheet 48 will cause the closure tab 46 to be folded around the sheet 48. The sheet 48 and the closure tab 46 will then be urged into the nip between former rollers 72, at least one of which is driven by the motor 30. Thus the closure tab 46 will adhesively engage the opposed edges of the sheet 48 for securely holding the sheet 48 in its closed folded condition.

Figure 5:
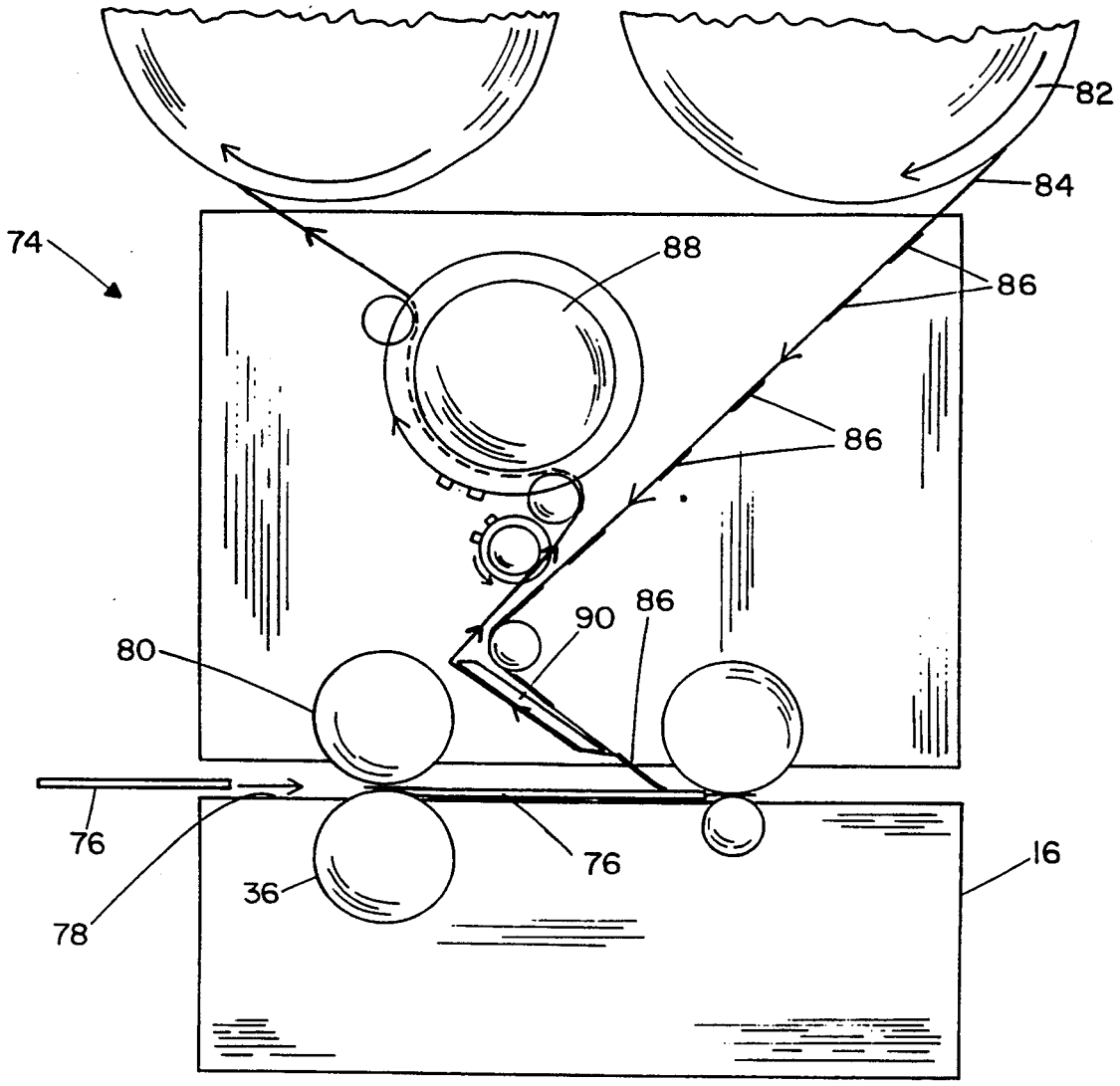
FIG. 5 is a cross-sectional view similar to FIG. 4, but showing a second operational configuration.

FIG. 5 shows an alternate applicator head 74 mounted to the postage meter base 16. The applicator head 74 is operative to apply labels to a sheet of material or an envelope 76 passing through a slot 78. As in the previous embodiment, the envelope 76 is driven by roller 36 in the postage meter base 16. The envelope 76 is guided against the drive roller 36 by an idler feed roller 80. A label reel 82 is mounted to the applicator 74 and delivers a carrier tape 84 with a plurality of labels 86 thereon. As in the previous embodiment, a pinwheel 88 is driven by the motor 30 in the postage meter base 16. The pinwheel 88 sequentially advances the carrier strip 84 sufficiently for moving a label 86 into a position for application to an envelope 76. More particularly, the carrier strip 84 passes around a peel bar 90 which causes the carrier strip 84 to undergo a substantially 180° change in direction. At this point, the label continues substantially linearly, as shown in FIG. 5, and is applied to the envelope 76 passing through the slot 78. Portions of the carrier strip 84 with the labels 86 removed are advanced to the take-up reel.

Figure 6:
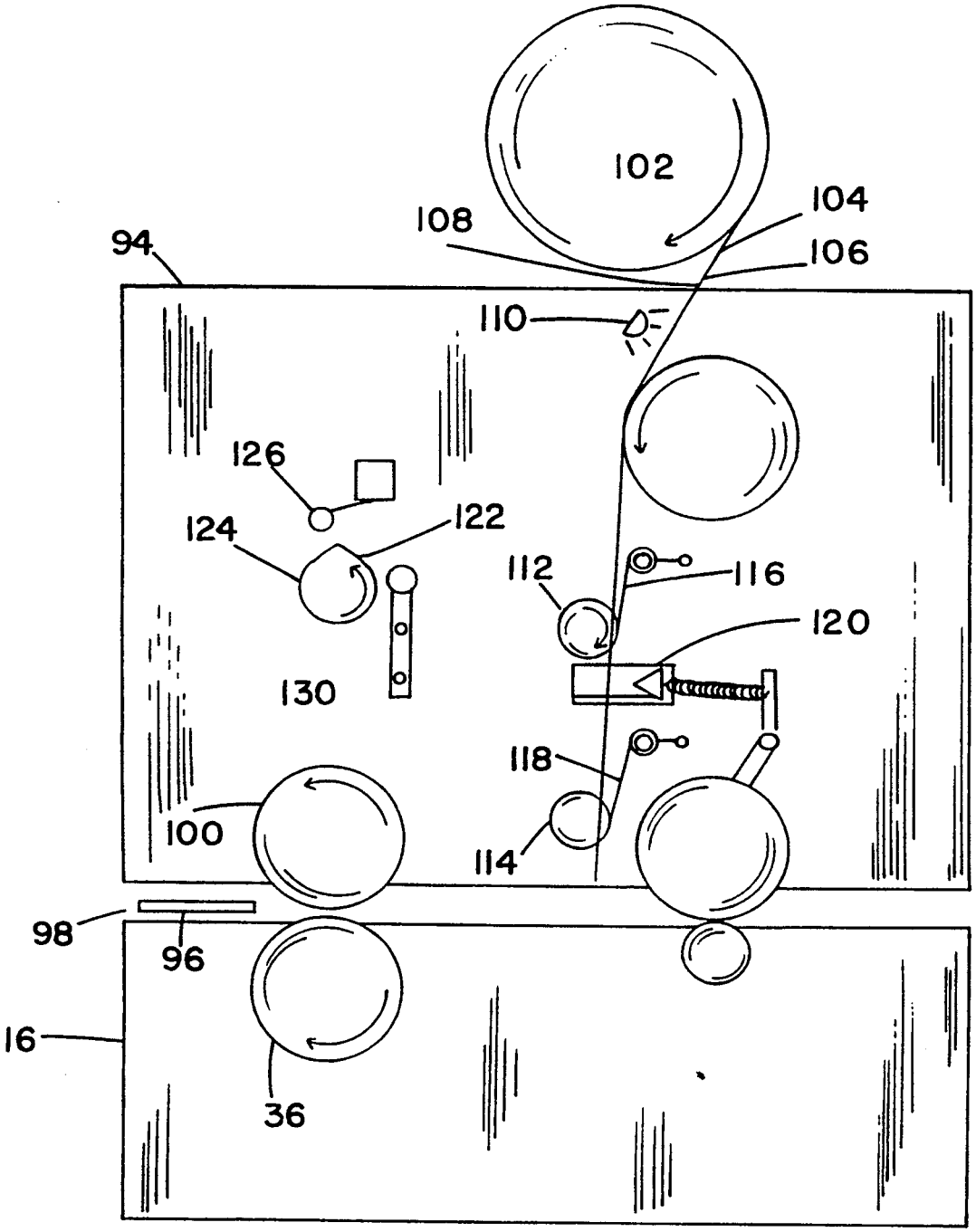
FIG. 6 is a cross-sectional view similar to FIGS. 4 and 5, but showing a third operational configuration.

FIG. 6 shows an alternate applicator head 94 mounted to the postage meter base 16. The applicator head 94 is operative to apply stamps sequentially to sheets of material or envelopes 96 passing through a slot 98 defined between the head 94 and the postage meter base 16. As in the previous embodiments, the envelope 96 is driven by a roller 36 in the postage meter base 16. The envelope 96 is guided against the drive roller 36 by an idler feed roller 100.

A stamp reel 102 is mounted in the applicator head 94 and delivers a strip 104 consisting of a plurality of unitarily interconnected stamps 106. Unlike the previous embodiments, no carrier tape is provided, and hence no take-up reel or associated feed rollers are provided. Stamps 106 on the strip 104 are separated from one another by optically detectable registration marks, such as printing on the strip or arrays of perforations defining lines of weakness. A photo-optical detector 110 is mounted in the applicator 94 and functions to optically detect registration marks.

The applicator head 94 further includes first and second drive rollers 112 and 114. The second drive roller 114 is disposed in proximity to the slot 98 between the applicator head 94 and the postage meter base 16. Thus, a portion of the strip 104 of stamps 106 engaged by the second drive roller 114 also will be in proximity to the slot 98 through which an envelope 96 may pass. First and second torsion springs 116 and 118 are disposed respectively in proximity to the first and second drive rollers 112 and 114. The torsion springs 116 and 118 are operative to urge the strip 104 of stamps 106 against the drive rollers 112 and 114.

A bursting blade 120 is disposed intermediate the first and second drive rollers 112 and 114 and at a distance from the photo-optical detector 110 to align with one registration mark 108 when another registration mark 108 is aligned with the photo-optical detector 110. The bursting blade 120 is selectively actuated to pierce through a portion of the strip 104 tensioned between the first and second drive rollers 112 and 114 by the respective first and second torsion springs 116 and 118.

The applicator head 94 further includes a main shaft 122 which is driven by the postage meter base 16 and which, in turn, drives rollers 112 and 114. A clutch (not shown) also is provided for selectively disengaging the main shaft 122 from the drive rollers 112 and 114 and a brake (not shown) is provided for stopping rotation of the rollers 112 and 114 after such disengagement. The main shaft 122 also is provided with a cam 124 which is disposed and dimensioned to selectively actuate a switch 126. The switch 126 is electrically connected to the photo-optical detector 110.

In operation, insertion of the envelope 96 into the slot 98 will trigger a switch in the slot 98 and generate rotational driving of the envelope 96 by the feed roller 36. Additionally, the main shaft 122 will commence its rotation, and the cam 124 thereof will contact the switch 126. This contact will cause the electric clutch on the main shaft to activate, thereby driving the rollers 112 and 114, and will send a signal to the photo-optical detector 110. The photo-optical detector 110 will then effectively look for the next registration mark corresponding to a separation between stamps, and on detecting the next registration mark will generate its own signal for de-energizing the electric clutch and energizing the brake to stop rollers 112 and 114. This will leave a section of the strip 104 securely retained against the first and second drive rollers 112 and 114 by the first and second torsion springs 116 and 118 respectively-Additionally, in this braked position, the bursting blade 120 will be aligned with a registration mark 108 identifying a line of severance for separating the leading stamp 106 at the end of the strip 104. The main shaft 122 continues rotating while the drive rollers 112 and 114 are braked, and hence the cam 124 thereof will rotate into a cam follower arm 130 which pivots and pulls the bursting blade through the strip 104 at the perforation line therein. This cutting is facilitated by the tension achieved by springs 116 and 118 and by the curved shape achieved by the convex configuration of the rollers 112 and 114. Continued movement of the envelope 96 under the action of the drive roller 36 will cause the envelope to engage the severed stamp 106, and the adhesive will cause the stamp and the envelope to be transported simultaneously into the nip between rollers 132 and 134 which securely adheres the stamp to the envelope.

An applicator 44, 74 or 94 can be selectively interchanged with the postage meter head 18 by merely moving the locking lever 38 into the forward position shown in FIG. 2 and lifting the head 18, 44, 74 or 94 from the postage meter base 16. The replacement head can then be mounted onto the postage meter base 16 and locked in place by merely moving the lever 38 rearwardly. It will be appreciated, however, that other locking mechanisms may be provided to facilitate the selective interchanging of heads on the postage meter base.

While the invention has been described with respect to a preferred embodiment, it is apparent that various changes can be made without departing from the scope of the invention as defined by the appended claims. In particular, other configurations of postage meter heads and postage meter bases can be used with one or more applicator heads in accordance with the subject invention. In all such variations, the applicators are driven by the motorized postage meter base, and include locking and driving mechanisms compatible with a particular postage meter head and postage meter base.

What is claimed is:

1. A modular apparatus for preparing sheets of material to be mailed, said apparatus comprising:

a postage meter base having a motor, feed means operatively connected to said motor for sequentially feeding the sheets of material relative to said base and a driver operatively connected to the motor and projecting from said postage meter base;

a postage meter head removably engageable with the postage meter base, said postage meter head including adjustable printing means driven by said driver of said base for sequentially printing indicia on the sheets of material driven by the postage meter base; and at least one applicator head removably engageable with the postage meter base upon removal of the postage meter head therefrom, said applicator head being engageable with the driver of the postage meter base for selectively applying adhesive backed applications to the sheets of material driven by the postage meter base, said applicator head comprising means for storing a strip of adhesive backed applications, means for selectively advancing said strip such that a leading application in said strip is in a position to be engaged by one said sheet driven by the postage meter base, and means for bursting said strip at a location for severing said leading application from said strip and enabling said application to be adhesively attached to said sheet of material driven by the postage meter base.

2. An apparatus as in claim 1, wherein the applicator head further comprises detector means for sensing when said leading application is in a position to be severed from remaining portions of said strip, said detector means being connected to the means for advancing the strip and being operative to stop the advancing of the strip when the leading applicator is in the position to be engaged by the sheet.

3. An apparatus as in claim 2, further comprising brake means connected to said means for sequentially advancing said strip and connected to said detector means, said brake means being for stopping the sequential advancing of said strip when said leading application is in said position to be engaged by said sheet of material.

4. An apparatus as in claim 2, wherein said detector means is a photo-optical detector which is operative to detect registration marks on said strip.

5. An apparatus as in claim 1, further comprising first and second strip gripping means on opposite respective sides of said means for bursting said strip, said strip gripping means holding said strip sufficiently tight to prevent movement in response to engagement of said strip by said means for bursting said strip.

6. An apparatus as in claim 5, wherein said means for selectively advancing said strip comprises first and second feed rollers disposed on opposite respective sides of said means for bursting said strip, said first and second strip gripping means comprising springs for tightly urging said strip against said first and second feed rollers.

7. An apparatus as in claim 6, wherein said feed rollers have concave outer surfaces for preventing curling of said strip around said feed rollers and achieving accurate guiding of said leading application into the position for engagement by the sheet of material.

8. An apparatus as in claim 1, wherein said applicator head further comprises a roller rotatably mounted for tightly urging said leading application into adhesive engagement with the sheet of material.

9. A postage stamp applicator for applying adhesive backed stamps to sheets of material, said stamp applicator being usable with a postage meter having a base with a motor and having a postage meter head removably attached to said base, feed means operatively connected to said motor for sequentially feeding the sheets of material along a feed path adjacent said base and a driver operatively connected to the motor and projecting from the postage meter base, the stamp applicator removably engageable with the postage meter base upon removal of a postage meter head therefrom comprising: means for storing a unitary strip of adhesive backed stamps, means for selectively advancing said strip such that a leading stamp in said strip is in position to be engaged by one said sheet driven by the postage meter base, and means for bursting said strip at a location adjacent said leading stamp and enabling said leading stamp to be adhesively attached to one said sheet of material driven by the postage meter base.

10. A stamp applicator as in claim 9, further comprising detector means for sensing when said leading stamp is in a position to be bursted from remaining portions of said strip, said detector means being connected to the means for advancing the strip and being operative to stop the advancing of the strip when the leading stamp is in the position to be engaged by the sheet.

11. A stamp applicator as in claim 10, further comprising brake means connected to said means for sequentially advancing said strip and connected to said detector means, said brake means being for stopping the sequential advancing of said strip when said leading stamp is in said position to be engaged by said sheet of material.

12. A stamp applicator as in claim 10, wherein said detector means is a photo-optical detector which is operative to detect registration marks on said strip.

13. A stamp applicator as in claim 9, further comprising first and second strip gripping means on opposite respective sides of said means for bursting said strip, said strip gripping means holding said strip sufficiently tight to prevent movement in response to engagement of said strip by said means for bursting said strip

14. A stamp applicator as in claim 13, wherein said means for selectively advancing said strip comprises first and second feed rollers disposed on opposite respective sides of said means for bursting said strip, said first and second strip gripping means comprising springs for tightly urging said strip against said first and second feed rollers.

15. A stamp applicator as in claim 14, wherein said feed rollers have concave outer surfaces for preventing curling of said strip around said feed rollers and for achieving accurate guiding of said leading stamp into the position for engagement by the sheet of material.

16. A stamp applicator as in claim 9, further comprising a roller rotatably mounted for tightly urging said leading stamp into adhesive engagement with said sheet of material.

* * * * *